United States Patent [19]

Koine

[11] Patent Number: 4,494,440

[45] Date of Patent: Jan. 22, 1985

[54] ARMING SETS FOR WEAPONS SYSTEM

[75] Inventor: Richard Koine, Ratingen, Fed. Rep. of Germany

[73] Assignee: Rheinmetall GmbH, Düsseldorf, Fed. Rep. of Germany

[21] Appl. No.: 898,462

[22] Filed: Apr. 14, 1978

[30] Foreign Application Priority Data

Apr. 16, 1977 [DE] Fed. Rep. of Germany ..... 2716892

[51] Int. Cl.[3] ..... F41D 10/14

[52] U.S. Cl. ..... 89/33.04; 89/33.05; 89/33.16; 89/186; 89/47; 89/135; 89/191 R

[58] Field of Search ..... 89/24, 33 A, 33 SF, 89/45, 186; 102/38 CC

[56] References Cited

U.S. PATENT DOCUMENTS 2,474,975 7/1949 Goodhue ..... 89/33 SF 3,008,258 11/1961 Johnson ..... 102/38 CC

*Primary Examiner*—Stephen C. Bentley

*Attorney, Agent, or Firm*—Karl F. Ross; Herbert Dubno

[57] ABSTRACT

A weapons system for single-barrel automatic cannons uses PRUNIT rounds consisting of a projectile and a casingless solid body of propellant affixed to the projectile. A respective arming set is provided for at least some of said weapons to form central units therewith. Each arming set comprises means defining first and second energy-flow paths with respective shafts adapted to transmit torque from input ends to output ends of the path. Both of the shafts are connected to a wedge-type breech block for shifting same between open and closed positions. One of the shafts is connected to a loader and the other to a belt feeder for the PRUNITs.

21 Claims, 9 Drawing Figures

FIG. 3
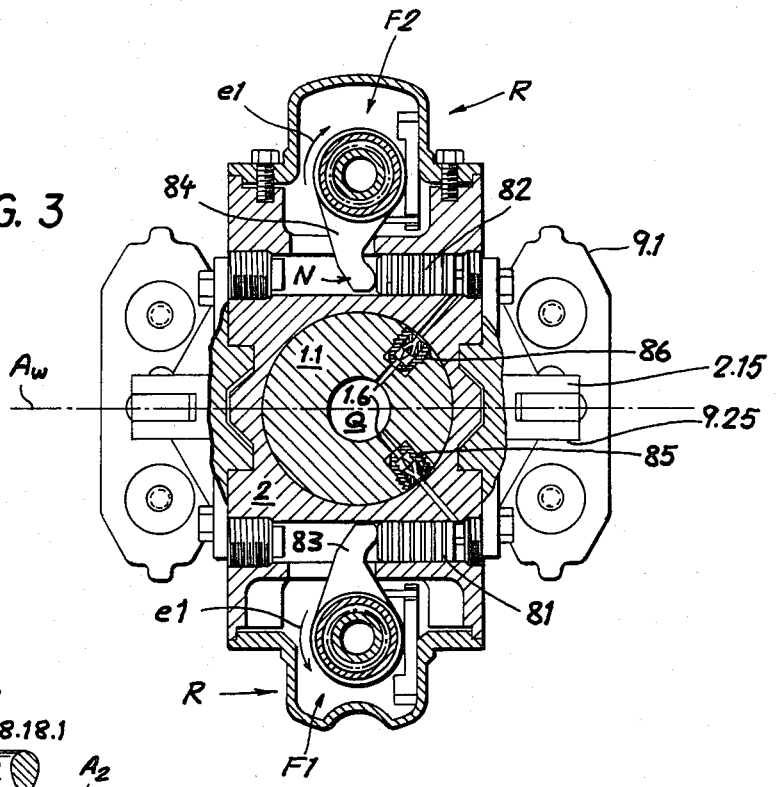
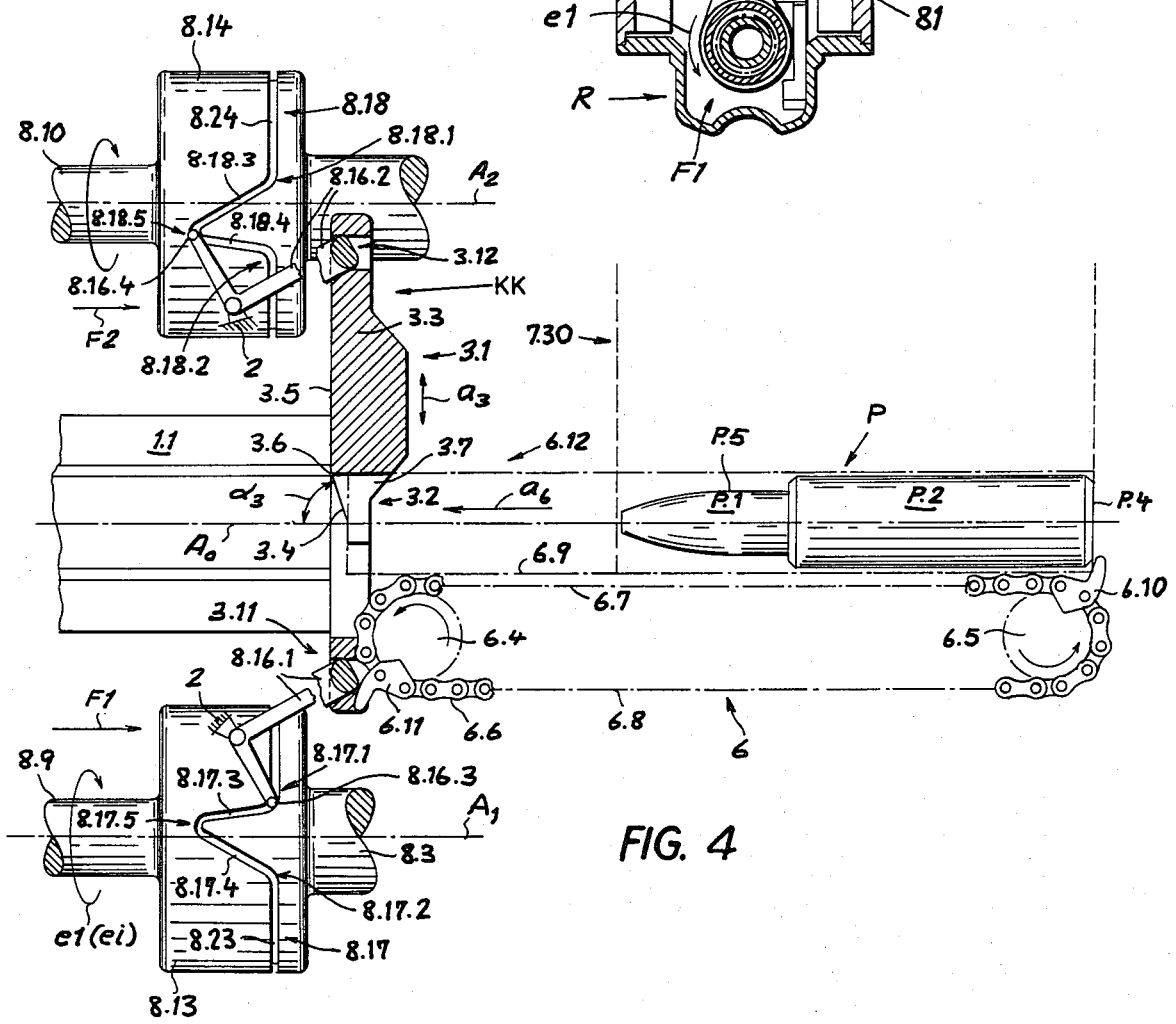
FIG. 4

ARMING SETS FOR WEAPONS SYSTEM

FIELD OF THE INVENTION

The present invention relates to a weapons system for single-barrel automatic weapons, especially automatic cannons, (wherein the munitions round has a casingless charge forming a unit therewith and is designated a PRUNIT.

BACKGROUND OF THE INVENTION

The deeply-staggered mobile deployment of military defense forces generally imposes high logistics requirements even if only the ammunition supply is considered. Advantageously high-rate firepower usually requires a correspondingly high rate of munitions supply as well as a sufficient and timely replenishment of the latter at the firing site.

With hand weapons there is a tendency to move to smaller caliber ammunition with a higher muzzle velocity and greater weapon-firing cadence to simplify the handling of the weapon and increase its fire power. Naturally, this can be accomplished only at the expense of a reduced firing range.

With small-caliber ammunition, especially so-called casingless munitions, at least a step forward is possible toward the goal of increasing the resupply volume. The logistical demands can thus be relieved, the storage and supply problems at the firing site alleviated and, in addition, the quantity of ammunition which must be carried by the individual soldier may then be reduced so as to be less burdensome.

However, with automatic cannons, logistic requirements relief is not possible to the same degree as it is with hand weapons. This is because, owing to the widely diverse field tasks and the different types of ammunition required (e.g. explosive, incendiary or armor-piercing), the caliber can be modified only to a limited extent. Here, practically the only positive effect on the logistical problems can be achieved through the use of projectiles of the casingless type.

Yet, single-barrel automatic weapons currently in use by the armed forces are generally poorly suited to the firing of unitary projectiles without casings. The reason for this is, on the one hand, the diversity of the mechanical stresses to which the various ammunition types are subjected and, on the other hand, the nature of the firing cycle and of the weapon components functionally participating in it.

With casingless munitions, no spent cartridges accumulate at the firing site. Thus, the quick-acting shell-extraction and ejection devices, which would be required in automatic weapons for removal of the fired-shell casings, are not needed. As a result, the structure of the weapon is simplified and its physical length can be significantly decreased.

It should be noted, moreover, that the aforementioned casing-removal devices also serve for the removal of duds or misfires to eliminate the risk of untimely detonation of the propellant charge by the thermal action of the heated weapon. The need for opening the breech of the weapon to remove such a dud or misfire is thus a drawback since it endangers the personnel.

However, with the use of casingless munitions rounds, it is also important to recognize that their transport from the usual magazine and their feeding to the weapon must be carried out with a lesser stress factor imparted to these rounds than is the case with cartridge-type or casing munitions.

Efforts have been made to improve upon weapons systems in a general way to reduce their construction and operating costs, to standardize them, or make them more rationally fit into the logistics arrangements for military operations. In the case of mobile weapons, for example, the gun mount must be so constructed as to take into consideration not only the recoil components upon firing so that the reaction forces can be held as low as possible, but also must create the circumstances for lightweight construction to facilitate mobility of the weapon.

In the supply of munitions to such weapons, furthermore, it is necessary to consider not only the handling of the munitions, the rate of supply and their advance toward the weapon, but also the different charge types, munitions functions and like considerations in designing the gun mount.

Finally, it is important to create a weapons system which is as maintenance-free as possible so that restoration, repair and down time are held to a minimum while the operating times and the life of the system are lengthened as much as possible.

One-piece munitions without a charge-receiving casing are often called "cartridges". The type of one-piece munitions to which the present invention is directed, however, has a propellant charge which is not surrounded by a cartridge or casing and which has the projectile fitted to a shaped charge at the leading end thereof. For the sake of clarity, in this description, such unitary rounds will be referred to by the acronym PRUNIT formed from the words projectile and unit. A prunit is thus a single-piece type of munitions without a charge-receiving sleeve or casing in which the projectile proper is bonded to a cast or pressed body formed from the propulsion charge.

In the published German application (Offenlegungsschrift) DT-OS 2 102 310, there is described an automatic weapon which is constituted as a single-barrel automatic cannon using casingless munitions. In this instance, the propellant charge is in the form of a liquid or gaseous medium which must be supplied to the weapon in predetermined (metered) quantities. Published German application (Offenlegungsschrift) DT-OS 2 135 001 describes an automatic weapon for projectiles that are separate from the solid-charge body.

In both cases, there still remains the problem of supplying or otherwise coordinating the joint delivery of the projectile and the charge at high weapon-operating cadences and at the desired location. To this end, special devices and control means are required which complicate the weapon by comparison to weapons operating with prunit munition rounds.

OBJECT OF THE INVENTION

It is an object of the present invention to provide an improved weapons system of the aforedescribed type which is free from the disadvantages of earlier weapons systems and is capable of operating with high fire power at high automatic-weapon cadences and without limitation of the munitions supply.

SUMMARY OF THE INVENTION

The foregoing object and others which will become apparent hereinafter are attained, in accordance with the present invention, in a weapons system which is especially intended for single-barrel automatic weapons, particularly automatic cannons designed to fire casingless munitions rounds of the PRUNIT type. According to the invention, the weapons system comprises a plurality of central units, each composed of a multiplicity of components for a predetermined number n of different base units or individual weapons, and respective z arming sets selective for combination with those base units to form a network of terminal devices. The latter may also include peripheral units for munitions supply and the like as well as a testing device for checking the functioning of predetermined components of the central unit.

In other words, the respective arming sets can be combined with various single-barrel weapons or base units to form a network of terminal devices which can be monitored by the testing device and can be associated in combinations with one another or individually with the peripheral devices.

The base devices or weapons can differ from one another with respect to their operating type, e.g. gas-pressure operated or self-actuated, externally powered, etc. and advantageously, each central unit can comprise a barrel with a charge-receiving chamber and two gas-venting bores traversing the barrel wall. The weapon housing can receive the other components of the central unit and thus can include a rigidly lockable breech block, a triggering device, an ignition device and a munitions loader as well as a munitions feeder.

In accordance with an important aspect of the invention, the munitions feeder can comprise two munitions inputs to the channel leading to the feeder and is preferably designed to advance either two prunits alternately or one of two types of prunits selectively, i.e. projectile units consisting of a projectile secured to a shaped solid charge of a propellant capable of ignition. The feeder, in addition, includes a selector for choosing between the two types of munitions advance to the loader.

According to another feature of the invention, the system includes means for eliminating a misfire or dud, preferably by igniting the propellant charge thereof, as well as means for cadence control of the system, i.e. determining the firing rate of the weapon. A base energy unit is provided to transfer, preferably as a torque, a pulse of primary energy or starting energy while the housing also includes two energy-flow paths which are mechanically coupled together for actuating the various components described above.

The central unit also includes a weapons cradle for the barrel and housing, a recoil/counterrecoil device floatingly mounting the central unit upon a respective gun mount. Means can be provided in this latter mechanism for storing a portion of the recoil secondary energy and using the same to initiate required operation of the weapon upon controlled release.

The base energy unit, according to the present invention, defines the aforementioned energy-flow paths and preferably has an input for each of these paths and a pair of outputs which can be selectively connected together. Preferably, the outputs of each of the paths include an inner output and an outer output and the two outer outputs are preferably connected respectively to the loader and munitions feeder.

Each arming set provides a connection between an energy source (primary energy source) and the two energy-flow paths mentioned previously, advantageously via an energy converter. Since the energy-flow paths are preferably provided as shafts and shaft-driven devices, the energy converter can advantageously be a transducer for transforming the impulsive energy to initiate firing operations, e.g. gas-pressure energy, into a torque suitable for actuation of these energy-flow paths. Depending upon the energy available and the nature of the energy-flow paths, respective energy converters will be employed. Means is provided for applying to one of the energy-flow paths an initial energy capable of initiating the first firing cycle when the energy source is gas pressure recovered from a prior firing, e.g. is provided by a propellant gas pressure.

According to yet another feature of the invention, the breech block, the loader, the munitions feeder and the ignition device constitute primary energy consumers and form, in common with the base energy unit, a primary chain. The two energy-flow paths are advantageously connected at their input sides to a respective or common arming set while two outputs of the energy-flow paths may be coupled together. The output-side coupling of the energy-flow paths is preferably effected by a coupling shaft including cam means or like timing means for the successive application of energy to the primary energy consumers mentioned above. Most advantageously, the breech block is a wedge-type slidable breech member which is engageable by a pair of cam-and-cam-follower arrangements of the two energy-flow paths and shafts respectively.

Depending upon the nature or operating type of the weapon, the gas-venting means thereof may be variable in cross section to complete blockage.

According to yet a further feature of the invention, the recoil/counterrecoil system forms a secondary chain with a signal generator or transmitter for initiating a repetition of the firing cycle during the counterrecoil movement of the weapon, the system including counterrecoil or resetting means for the barrel.

By providing a connection between the latter signal transmitter, the breech-control system and the ignition device, it is possible to establish a predetermined counterrecoil firing sequence of n-a of n controllable firing cycles where n is substantially greater than 1 and a represents the initial or starting firing cycle of the weapon.

The triggering device, the breech block and a portion of the barrel or chamber in which the projectile is received, are provided with signal generators or transmitters for the ignition device. Most desirably, signals are generated to represent complete insertion of the projectile into the chamber, complete closure and locking of the breech, and movement of the projectile ahead of the expanding gases upon ignition. These signals are used to control the subsequent energy-distribution and energy-conservation or recovery steps in the actuation of the device.

Advantageously, in the absence of a signal from a signal transmitter representing movement of the projectile through the barrel of the weapon, the system is enabled to permit a misfire to be removed, e.g. by supplemental ignition of its charge.

In still another feature of the invention, the weapon cradle is integrated at least in part in a housing of the recoil/counterrecoil device.

Each of the arming sets integrated in a predetermined base weapon unit constitutes a form-change set for the respective weapon unit. The peripheral units include various mounts which can be designed to receive each at least one base unit or single-barrel weapon, respective devices for retaining a munitions supply proximal to the weapons and for handling the munitions supply, as well as means for otherwise rendering the weapon a viable unit.

The present invention has the significant advantage that it provides a weapons system for automatic weapons which can effectively use prunits with all of the advantages of cartridge-type munitions but without the disadvantages of having to handle spent casings or misfires which must be removed from the chamber of the weapon. The technological advantage of prunits is thus realized simultaneously with an improved fire power and effectiveness since the force-transmitting connection of the components of the central unit for operation by the respective energy paths allows an especially high cadence of fire and hence fire power even with low-caliber munitions.

In addition, the system is more reliable than earlier arrangements and, especially, allows elimination of misfires in a particularly convenient manner with the breech completely locked so that there is little if any danger to operating personnel.

Furthermore, since complex mechanisms are not required to withdraw cartridges or casings from the firing chamber of the weapon, the overall size of the weapon can be reduced.

Since the same central unit can be used for various purposes, e.g. for aircraft, ground vehicles, field weapons and the like, a cost-reduction standardization can be effected with an improvement in logistics and weapons expenditure. Note also that the interchangeability of the arming sets and the peripheral units ensures that a wide variety of total weapons systems and autonomous and integrated weapons combinations can be provided both for permanent or field-emplaced applications and for air and sea craft and like carriers. Maintenance is reduced and part-replacement is facilitated.

BRIEF DESCRIPTION OF THE DRAWING

The above and other objects, features and advantages of the present invention will become more readily apparent from the following description, reference being made to the accompanying drawing in which:

FIG. 3 is a cross sectional view taken along the line III—III of FIG. 2;

FIG. 4 is an elevational view, partly in cross section and with portions removed, of the mechanical coupling chain for control of the various components of the system;

SPECIFIC DESCRIPTION

Figure 1:
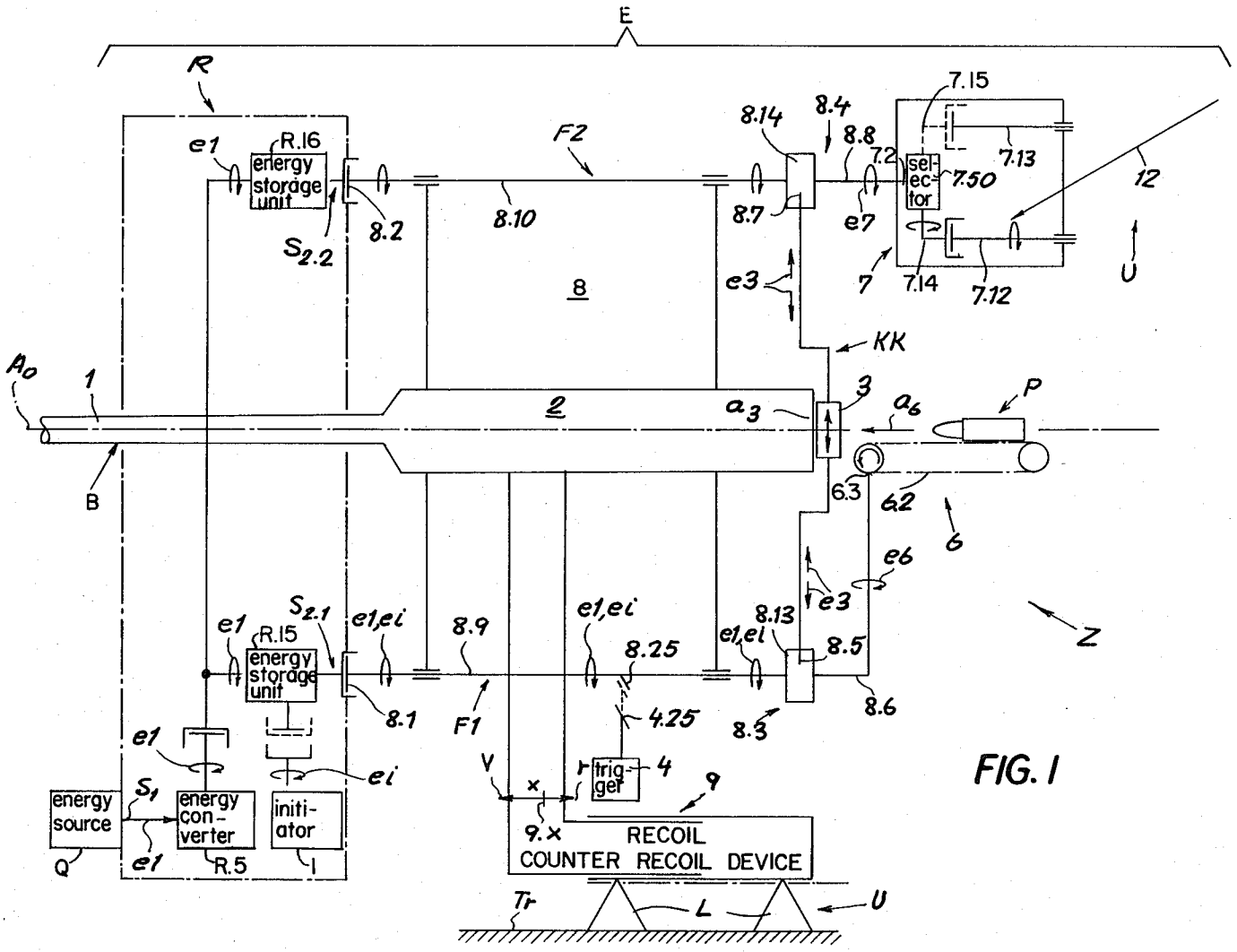
FIG. 1 is a diagrammatic elevational view of the components of the terminal device of a weapons system of the present invention, this terminal unit including a single-barrel automatic cannon.

FIG. 1 shows the functional relationship of a terminal device system E which is provided with a support generally designated at Tr. (In the following description, for simplification, the components of the system designated in capital letters will omit as far as possible the use of these reference indicia.)

The terminal system E includes a base unit B which comprises a weapon, namely, a single-barrel automatic cannon for munitions in which a projectile is propelled by a solid casingless charge. Such munitions have been described above and will be described hereinafter as prunits, i.e. projectile/casingless propellant units. The system E of FIG. 1 also includes a central unit Z, an arming set R and peripheral units U as well as the gun mount which has only been symbolically illustrated in FIG. 1 and which is provided at 12 with a munitions supply device proximal to the weapon, $B_1 \ldots B_n$ weapons being associated with $R_1 \ldots R_k$ arming sets where k can be equal to or less than n.

Further components of the terminal aggregate E will be described in connection with FIGS. 6–9.

Figure 5:
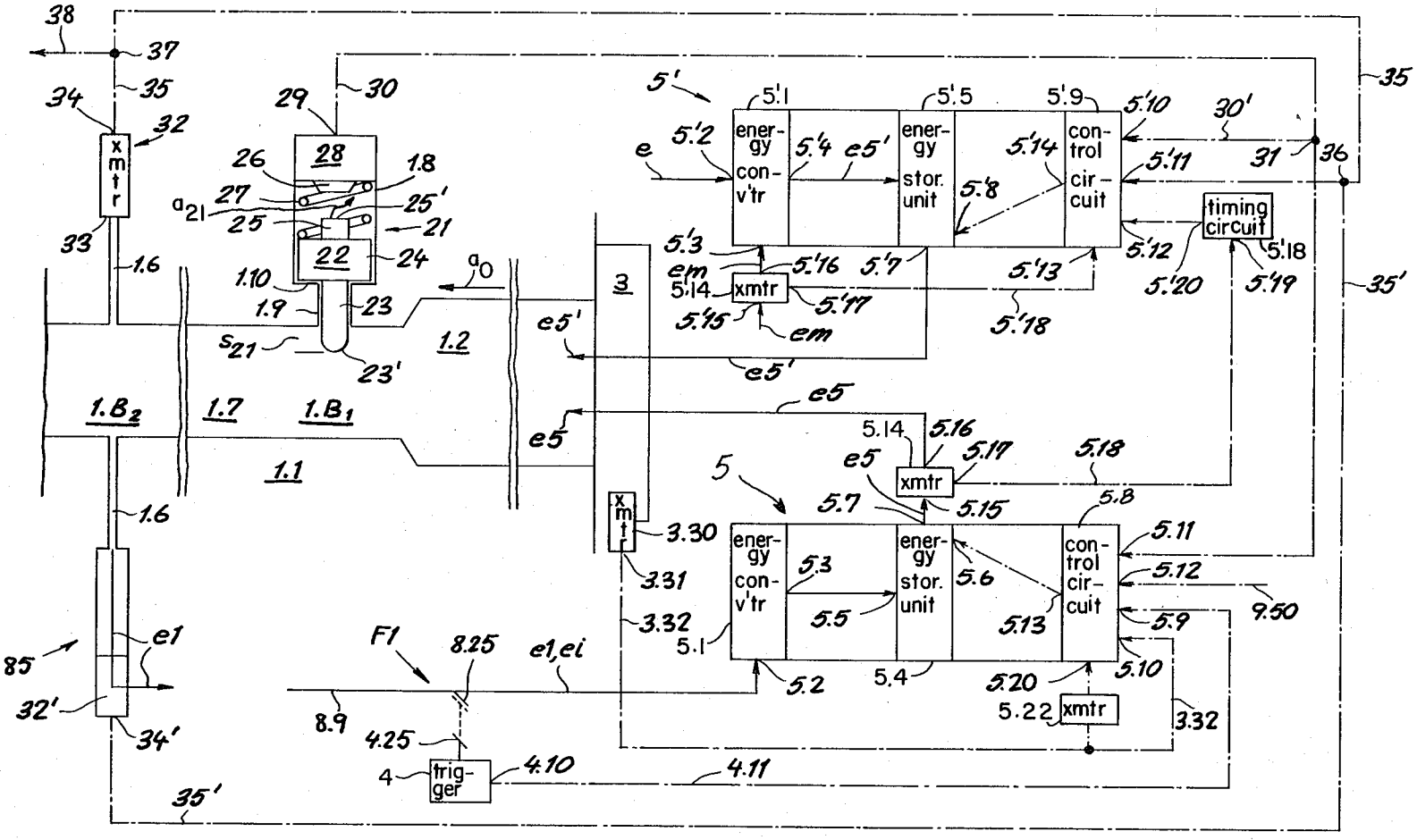
FIG. 5 is a flow diagram illustrating the operation of another portion of the system.

The central unit Z comprises, as its main components, a barrel 1 having a bore axis $A_0$, a weapons housing or chamber 2, a breech block 3, a triggering or firing device 4, a loader 6, a munitions feeder 7, an energy source Q, an energy transfer system 8, a recoil/counter-recoil device 9, a weapons cradle or rocker W (FIG. 6) as well as an ignition device 5 and a misfire or dud remover 5' (see FIG. 5).

The barrel 1 is provided with a barrel wall 1.1 which is formed with a charge or powder chamber 1.2 (FIGS. 4 and 5) and with two gas-venting bores 1.6 (FIG. 3). In its interior 1.7, a sensor 22 is provided (see FIG. 5). This sensor will be described in greater detail below.

The breech block 3 is of the wedge-type. The weapon housing or chamber 2 serves to receive the components and devices of the central unit Z to unite them spatially and functionally.

The energy-transfer device 8 comprises, as is also apparent from FIG. 1, a first and and a second energy-flow path $F_1$, $F_2$.

These energy-flow paths are formed within energy unit 8 by respective shafts 8.9 and 8.10 which are journaled for rotation about respective axes in fixed locations or bearings of the housing.

The energy (primary energy $e_1$ or initial energy $e_i$) is transferred via unit 8 in pulses as torques and hence the shafts 8.9 and 8.10 each have a respective energy input 8.1 and 8.2 and a respective energy output 8.3 and 8.4. The energy inputs and outputs can be effected via clutches, gears or transmissions.

The output 8.3 includes an inner energy take-off location 8.5 and an outer energy take-off location 8.6. Similarly, the output 8.4 includes an inner and an outer energy take-off location 8.7, 8.8, respectively. For the inner and outer energy take-off locations, in order to simplify the further description, these will be designated simply as energy pickups or takeoffs.

The shaft 8.9 is formed in a region between its input 8.1 and its output 8.3 with a coupling abutment 8.25 which cooperates with a coupling cam 4.25 for the selective release and interruption of the energy flow in the primary chain. The output 8.6 is connected with the loader 6 while the output 8.8 is connected with the munitions feeder 7, each in a positive or form-locking manner.

As further shown in FIG. 1, there is provided on each of the shafts 8.9, 8.10, at their respective output regions, a limit or disk member 8.13, 8.14 of a mechanical coupling chain KK (see FIG. 4).

Each input 8.1, 8.2 forms a respective intersection $S_{2.1}$, $S_{2.2}$ for the force-transmitting connection with corresponding elements of the arming device or set R.

The arming device R completes the energy transfer unit 8 to actuate the several components and devices of the central unit Z. The connection of the energy source Q to one of the intersections $S_1$ and the relationship to the system of the initiator I which provides the initial energy $e_i$ for the first firing cycle will be described subsequently.

The mechanical coupling chain KK includes elements for the powering of the individual components and devices of the central unit Z and have been illustrated in greater detail in FIG. 4.

As shown in that Figure, each limit member 8.13, 8.14 includes a body of substantially rotation-symmetrical cross section with a peripheral region equidistant from the respective axes $A_1$, $A_2$, the latter lying in the same plane as the bore axis $A_0$.

Each of these peripheral regions is provided with a control groove 8.17, 8.18, forming slave cams for respective cam follower members. Each control groove 8.17, 8.18 has a stretch 8.23, 8.24 lying in a plane perpendicular to the axis $A_1$, $A_2$, respectively, in which the cam follower undergoes no excursion upon rotation of the respective cam disk 8.3, 8.4. These portions 8.23 and 8.24 of the cam grooves extend over the major part of the periphery of the respective disks. The ends of the stretches 8.23 and 8.24 have been represented at 8.17.1 and 8.17.2, 8.18.1 and 8.18.2, respectively.

Between these regions, the cam grooves 8.17 and 8.18 have a V-shaped profile with two diverging straight-line branches 8.17.3, 8.17.4 and 8.18.3, 8.18.4, respectively, the two branches of each groove being bridged by a reversing region or bight 8.17.5 or 8.18.5, respectively. The cams operate complementarily. The branches 8.17.3–8.17.5 and 8.18.3–8.18.5 are on the portions of the slave-cam grooves effecting excursion of the cam followers.

As further shown in FIG. 4, the coupling chain KK also includes two bell crank levers 8.16.1 and 8.16.2, disposed mirror-symmetrically with respect to one another, and each having a relatively long lever arm and a relatively short lever arm. These levers are fulcrumed upon the chamber or housing 2 previously described. More specifically, at the vertex of each of the bell crank levers, they are pivotally secured to the housing 2 proximal to the energy-flow paths $F_1$, $F_2$.

Each of the short lever arms comprises a cam follower formation 8.16.3, 8.16.4 perpendicular to the respective axis $A_1$, $A_2$ and guided in the respective cam groove 8.17, 8.18.

Each of the long lever arms is provided with a linkage 3.11, 3.12, e.g. in the form of a pivot or rocker, with a breech body 3.1 so as to displace the latter in the direction of the arrow $a_3$ between its upper and lower positions. The breech block 3 (FIG. 1) thus constitutes the central coupling member of the coupling chain KK.

Figure 2:
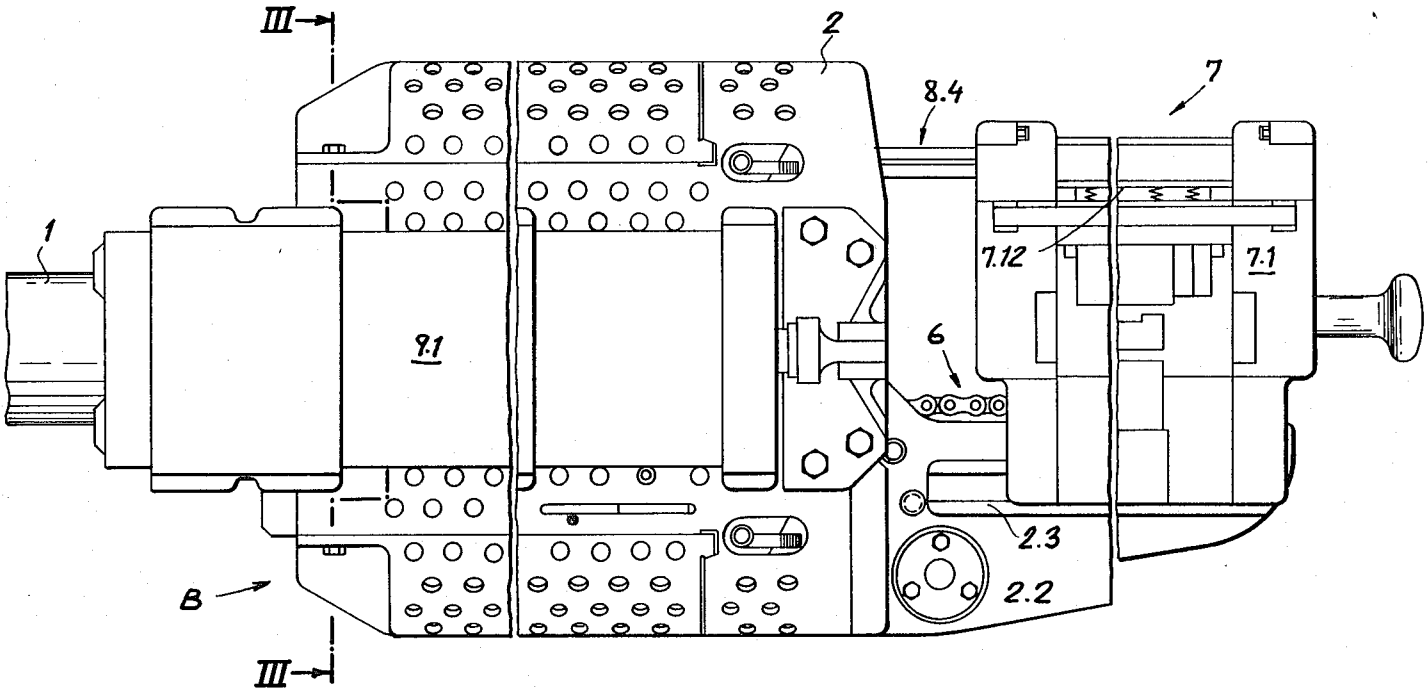
FIG. 2 is a vertical elevational view of a portion of the weapon of FIG. 1 constituted as a blowback-operated or gas-operated gun.

The loading device or loader 6 is provided on a rearwardly projecting portion of the weapon housing (FIG. 2). As can be seen from FIGS. 1, 2 and 4, the loader 6 comprises a direction-change drive 6.2 only the input side of which can be seen in FIG. 1. This transmission drives the front sprocket wheels 6.4 of an endless-chain arrangement whose rear sprocket wheels 6.5 are rotatably journaled. An endless loading chain 6.6 passes around the sprocket wheels 6.4, 6.5.

As shown in detail in FIG. 4, the loading chain 6.6 is provided so as to be tensionable between the two sets of sprockets 6.4, 6.5 and is constituted as a rover chain having an upper stretch 6.7 and a lower stretch 6.8. The upper level of the upper stretch 6.7 is designated at 6.9 and the chain is provided with entraining fingers 6.10 and 6.11 which are adapted to project above this level 6.9. The lever 6.9 runs parallel to the bore axis $A_0$ and extends over the length of the round-feed zone 6.12 which is defined between dot-dash lines in FIG. 4. The prunit P shown in FIG. 4 has just been placed upon the upper stretch 6.7 of the chain and is about to be advanced in the direction of arrow $a_6$ into the chamber 1.2 of the weapon. An input 6.3 of the transmission 6.2 serves to connect the latter to the energy output location 8.6 previously mentioned.

The munitions feed device 7 is enclosed in a housing 7.1 which lies in a recess 2.3 of the weapon housing 2.2 as shown in FIG. 2. As shown in more detail in FIG. 1, the housing 7.1 receives a drive shaft 7.2 which is rotatable from the energy output 8.8 mentioned previously. The munitions feeder 7 also includes, on the left and right sides thereof, respective feeder inputs 7.12 and 7.13 operated respectively by the advancing shafts 7.14 and 7.15 with the respective conveyor devices. Such conveyor devices can be belts, pockets or the like for receiving the individual rounds of prunit munitions. The device can also be used to convey belted munitions, i.e. rounds previously inserted in respective pockets in a belt (see FIGS. 6–9).

A selector 7.50 (FIG. 1) is provided for controlling the feed of the individual rounds to the chain 6.6 from either or both of the feeder inputs 7.12 and 7.13. Thus, the rounds may be fed alternately from one and the other of these feeder inputs 7.12, 7.13 or only from one of the inputs. When each feeder thus contains a respective type of munition (A rounds or B rounds), the selector 7.50 can be used to rapidly change the type of munition fired. The munition feeder 7 is provided with a munitions path represented at 7.30 in dot-dash lines in FIG. 4 for delivering the rounds in succession to the conveyor 6.6.

The device 5' for the removal of duds or misfired rounds from the chamber 1.2 of the weapon has been illustrated in greater detail in FIG. 5. This device 5' includes a second ignition device which will be described in connection with the main firing or ignition device.

The ignition device 5 includes an energy converter 5.1 (FIG. 5) having an input 5.2 for the primary or initial energy $e_1$, $e_i$ and an output 5.3 for the ignition energy $e_5$. It also includes an energy storage unit 5.4 for the ignition energy $e_5$ and an output 5.7 of this energy storage device to which is connected a control circuit 5.8 with five signal inputs 5.9, 5.10, 5.11, 5.12 and 5.20. The latter input is provided with an auxiliary signal transmitter 5.22. The output 5.7 for the ignition energy $e_5$ feeds a signal transmitter 5.14.

The signal input 5.9 is connected via line 4.11 with a signal output 4.10 of a signal transmitter (not shown) of the triggering device 4.

The breech block 3 is also provided with a signal transmitter 3.30 producing an output at 3.31 when the breech is fully locked. This output 3.31 is connected via a line 3.32 to the signal input 5.10. A region 1.$B_1$ of the weapon is provided with a signal transmitter 21 or sensor for the loading state of the barrel 1. The signal output 29 of this sensor is connected via a line 30 with the signal input 5.11 previously described. Still another transmitter, not further described herein, is represented at 9.X in the recoil/counter-recoil device 9 and has its output connected via a control line 9.50 with a signal input 5.12.

Similarly, the device 5' for removing or eliminating misfires or duds includes an energy converter 5'.1 with a first and a second energy input 5'.2 and 5'.3, an energy storage unit 5'.5 and a control circuit 5'.9 to which the output 5'.7 of the device responds. The control circuit 5'.9 has four signal inputs 5'.10, 5'.11, 5'.12, 5'.13.

The signal input 5'.10 is connected via a line 30' to a junction 31 with the line 30. A region 1.B$_2$ of the weapon is in communication with one of the gas-venting bores 1.6 which is provided with a signal transmitter 32 which senses the operating condition of the weapon. The output 34 of the signal transmitter 32 is connected via line 35 with the signal input 5'.11.

The signal input 5'.12 is provided with a time-delay network 5'.18 whose input 5'.19 is connected via a line 5.18 with an output 5.17 of the signal transmitter 5.14. The second energy input 5'.3 is provided in series with a signal transmitter 5'.14 whose output 5'.17 is connected via the line 5'.18 with the signal input 5'.13.

The signal transmitter 21 in the region 1.B$_1$ (FIG. 5) is constructed as follows:

The barrel wall 1.1 is provided with a bore 1.8 of circular cross section to which a circularly cylindrical coaxial bore 1.9 of lesser diameter is connected. The latter communicates as a throughgoing passage with the interior 1.7 of the barrel. The bores 1.8 and 1.9 together form a receptacle for the piston-type sensor 22 of circular cross section. This receptacle is formed in the wall 1.1 and has a step 1.10.

The sensor 22 has a lower free end 23 and an upper free end 25 with a shoulder 24 between these ends.

The end 23 is formed with a ball-shaped (spheroidal or rounded) surface 23' while the end 25 is bounded by a contact surface 25'.

At a distance $s_{21}$ from the contact surface 25', the receptacle formed by the bores 1.8 and 1.9 is provided on its upper side with a countersurface 26 having elements 28 which seal the receptacle hermetically and in a pressure-tight manner.

The sensor 22 projects with its end 23 and is biased in this direction by a compression spring 27 into the interor 1.7 of the barrel but can be depressed against the force of this spring in the direction of arrow $a_{21}$. The extent to which the sensor can be displaced is the distance $s_{21}$ (signal stroke). This outward displacement of the sensors 22, 23 by the projectile end P.1 of the prunit P when the latter is inserted into the chamber 1.2, causes the contact surface 25' to engage the countersurface 26 and generate a signal which is released from an output 29 of the element 28, this output being connected via line 30 to the signal input 5.11 of the control circuit 5.8 and being also applied via the line 30' and the signal input 5'.10 to the control circuit 5'.9.

The operating relationship between the various components described will become more readily apparent from the detailed discussion of the operation of some of these components given below. Particular reference is made to FIGS. 1, 4 and 5 and the description is directed to the first and a subsequent firing cycle.

In the following description, the various parts will be assumed to have the positions indicated prior to the operations set forth. For example, the catch abutment 8.25 of the shaft 8.9 is lockingly engaged with the catch cam 4.25 of the triggering device 4 as shown in broken lines in FIG. 1. In the preparatory stage, a prunit P lies in the region 6.12 rearwardly of the breech of the weapon. The breech block 3 is in its upper position and the follower 8.16.3 lies in the region 8.17.1 of the cam 8.17. The cam follower 8.16.4 is disposed in the reversal region 8.18.5 of the cam groove 8.18. The input 8.1 and the input 8.2 are connected with units of the arming device R, for example the energy storage units R.15 and R.16, and hence with the energy source Q. The energy flow path $F_1$ of the initiator I is enabled or ready to be connected. Force-transmitting means, e.g. a clutch of the initiator I and connected to the input R.15 is disengaged (broken line in FIG. 1). At the inputs 8.1 and 8.2 there is no torque.

To initiate a first firing cycle, the initiator I in engaged with the input R.15 and the energy $e_i$ is delivered to the energy storage unit R.15 in the form of a torque. The force-transmitting relationship between the initiator I and the energy-storage unit R.15 is then interrupted. A torque is thus applied to the input 8.1 at the intersection $S_{2.1}$.

The weapon B is ready for firing.

Upon actuation of the triggering device 4, the catcher cam 4.25 is released from the catcher button 8.25 (solid lines in FIG. 1) and the energy flow through the primary chain is released. The first firing cycle is thereby initiated.

The shaft 8.9 is rotated in the clockwise sense so that, at the output 8.3, an energy-flow branching occurs. At the other output 8.5 (embodied by the cam groove 8.17 between the regions 8.17.1 and 8.17.2 in cooperation with the cam follower 8.15.3) an energy transfer $e_3$ is effected. At the other output 8.6, an energy transfer $e_6$ is effected. Both these energy transfers are in the form of incremental torques.

Rotation of shaft 8.9 in the clockwise sense thus causes rotation of the cams and the groove 8.17 and 8.18 so that the respective cam followers 8.16.3 and 8.16.4 effect the closure of the breech block 3 (arrow $a_3$).

The shaft 8.10 is rotated and at the output 8.3 thereof the energy transfer $e_7$ constitutes a torque which operates the munitions feeder.

The energy transfer $e_6$ actuates the loader 6 as follows:

The increment of torque is applied via the transmission 6.2 to the chain sprocket 6.4 to rotate the latter in the counterclockwise sense and advance the prunit P in the direction of arrow $a_6$ to the chamber 1.2 of the weapon.

The torque $e_7$, in turn, operates the munitions feeder 7, depending upon the selector 7.5 to advance one of the rounds from one of the feeders 7.12, 7.13, via the path 7.30, to the conveyor 6. The path 7.30 is disposed directly above the receiving stretch of conveyor 6 and has a corresponding length (equal approximately to that of the prunit).

Because of its connection with the energy-flow path $F_1$, the input 5.2 of the energy converter 5.1 receives a portion of the energy $e_i$. The energy requirement $e_5$ for ignition is delivered by a connection between the output 5.3 and the input 5.5 of the energy-storage device 5.4.

A signal from the triggering device 4 is applied by signal output 4.10 via the line 4.11 to the signal input 5.9 of the control circuit 5.8.

The breech-block member 3.1 has a round-feed portion 3.2 formed with a window through which the prunit P can pass, and a breech-closing portion 3.3 whose surface 3.5, turned toward the chamber 1.2 of the weapon, seals this portion. The infeed surface 3.4 is effective when the feed portion 3.2 of the breech member is aligned with the chamber as has been illustrated in FIG. 4.

Both of these surfaces have an edge 3.6 which lies parallel to the bore axis $A_0$ and is perpendicular to the surface 3.5 while including with the infeed surface an angle $\alpha_3$.

The feed portion 3.2 of the breech member is provided with a feed passage 3.7 which is aligned with the chamber 1.2 in the feed position of the breech block.

As soon as the prunit P traverses the feed passage 3.7 to the extent that its base surface P.4 leaves the ready region 6.12, the feed surface 3.4 engages the base P.4. As the breech block closes, therefore, the prunit P is advanced further into the chamber by a feed distance 3.12 ahead of the path of the prunit on the chain 6. The finger 6.11 is meanwhile prepared to pick up another prunit from the guide 7.30.

As a result of further rotation of the shafts 8.9 and 8.10, the cam follower 8.16.3 passes along the reversal region 8.17.5 while the cam follower 8.16.4 passes into the region 8.18.2 of the respective cams 8.17, 8.18. The breech is thereupon completely closed by the surface 3.5 and the chamber contains the solid charge P.2 of the prunit P while the projectile P.1 lies in the region 1.B$_1$ of the weapon.

The breech block 3 thus finds itself in the locked state after consumption of the energy $e_i$.

As illustrated in FIG. 5, the signal "locked" is formed in the signal transmitter 3.30 and is delivered by its output 3.31 via line 3.32 to the signal input 5.10 of the control circuit 5.8.

A peripheral region P.5 (FIG. 4) of the projectile P.1 has, by passage into the region 1.B$_1$ of the bore 1.1 of the weapon, as further shown in FIG. 5, engaged the spheroidal or ball-shaped surface 23' of the sensor 22 and urged the latter against the force of the compression spring 27 through the control stroke $s_{21}$ in the direction of the arrow $a_{21}$ until contact occurs between the contact surface 25' and the countersurface 26. This generates in the switch element 28 a signal "loaded" which is applied from the output 29 via line 30 to the signal input 5.11 of the control circuit 5.8. It is also applied, via the junction 31 and the line 30', to the signal input 5'.10 of the control circuit 5'.9 for eliminating a misfire.

The result of the application of these signals to the control circuit 5.8 is the formation of a summing signal (addition signal) which, via the connection between the output 5.13 with the signal input 5.6, opens the energy output 5.7 of the ignition-energy storage unit 5.4.

An ignition energy increment $e_5$ is thus applied to the chamber 1.2 by the signal transmitter 5.14 whose output signal represents the state "ignition-energy applied". This signal is applied in the aforedescribed manner to the input 5'.12 of the control circuit 5'.9. In the meantime, the energy increment $e_5$, when applied to the charge in the chamber 1.2 of the weapon ignites the charge P.2 of the prunit to propel the projectile P.1 from the barrel 1.1.

The projectile P.1 moves as a result of the energy developed by the expanding gases behind the projectile in the direction of arrow $a_0$ and thus leaves the region 1.B$_1$ of the barrel to free the sensor 22. As it passes the region 1.B$_2$, however, the gas-venting bore 1.6 is exposed to the pressure of the gas behind the projectile and the transmitter sensors 32, 33 thereby generate a signal representing "fire development". This signal is applied to the control circuit 5'.9 as a quenching signal for the previous enablement of this control circuit. Naturally, the "fire development" signal represents a state of the weapon excluding a misfire or dud so that the system for relieving the weapon of a misfire is not necessary.

In a manner to be described subsequently, at least one of the gas-venting bores 1.6 is connected with the energy source Q and/or a device in series therewith in the energy-flow direction and forming part of the central unit and in force-transmitting relationship with the arming device R.

The signal "fire development" triggers the release of a primary energy pulse $e_1$ from the energy source Q to the arming device R via the inputs 8.1 and 8.2 previously described. In this case, the energy flow along path $F_1$ and $F_2$ is not interrupted by the catcher cam 4.25.

Referring again to FIG. 4, it can be seen that the breech block 3 is rigidly locked. The cam follower 8.16.3 is located at 8.17.2 while the cam follower 8.16.4 is disposed at the symmetrically opposite region 8.18.5. The flow of a portion of the applied energy $e_1$ along the path $F_1$ in an unimpeded manner effects a rotation of the shaft 8.9 and generates an energy increment $e_6$ which is applied to the loader 6 as long as the cam follower 8.16.3 is in the portion 8.23 of the cam groove 8.17. Only when this cam follower reaches the region 8.17.3, is there a branching of an increment of energy $e_3$. The cam follower 8.16.4 leaves the reversal region 8.18.5 which terminates the fixed locking of the breech block 3. The primary energy ready at the input 8.2 can thus pass along the energy-flow path $F_2$ and is applied with branching between the inner output 8.7 and the outer output 8.8, in addition to the energy increment $e_3$ from the energy-flow path $F_1$. The munitions feeder 7 is thus actuated to advance another round. As soon as the cam follower 8.16.4 reaches the region 8.18.2, mechanically synchronously with the positioning of the cam follower 8.16.3 in the reversal region 8.17.5 of its cam groove, the breech block is shifted into its open position. The cam follower 8.16.4 then enters the region 8.24 of the camming groove 8.18 and the primary energy is applied via path $F_2$ to the munitions feeder 7 for this advance of the next round.

The breech block 3 remains in its "open" position until the cam follower 8.16.4 again enters the region 8.18.1 of its cam groove. Upon the re-entry of the cam follower 8.16.4 into the region 8.18.3 of the groove, a rigid blocking of energy branching between the inner output 8.7 and output 8.5 occurs so that the breech block is then closed as has been described with respect to the first cycle.

The firing of each round during a preceding firing cycle and, naturally, the firing of the first round during the first firing cycle, gives rise to secondary energy in the form of a recoil force. This recoil force causes the weapon to move in the direction opposite the firing direction (arrow $a_0$) through a predetermined stretch (recoil stretch). A portion of the secondary energy is recovered and stored in the recoil-counterrecoil device 9 (see German patent application P 26 557 08.4) and can be used as a secondary chain to return the weapon to its firing position.

The recoil/counterrecoil energy storage and use system 9 includes the aforementioned signal transmitter 9.X. The latter, at a predetermined location in the recoil movement X provides an output representing a signal "advance X" which is applied via line 9.50 (FIG. 5) to the signal input 5.12 of the control circuit 5.8.

Assuming that the aforedescribed control signals have previously been applied to the circuits 5.8 and 5'.9 as enabling signals, the application of the signal "advance X" initiates in the control circuit 5.8 the formation of the aforedescribed addition signal which at its output opens the ignition energy storage unit 5.4. An interruption of firing at a predetermined location X of the counter-recoil or advance stretch (counter-recoil firing according to German patent application P 26 55 708).

Assuming that the triggering device 4 permits free flow of the energy along paths $F_1$ and $F_2$ in the primary chain, the firing cycle will be repeated with a predetermined cadence (see German patent application P 26 58 770.2) as long as the weapons supply lasts. This of course assumes that there is no misfire.

In the event of a dud or misfire, the "fire development" signal which is applied as the quenching signal to the control circuit 5'.9 is not released and the signal input 5'.12 is rendered effective from the timing circuit 5'.18.

In the latter, upon the receipt of the "ignition energy flows" signal, after a period sufficient to allow fire development, a signal "misfire" is generated and is applied to the circuit 5'.9. This results in the generation of an addition or summing signal to open the output 5'.7 of the energy storage unit 5'.5 to release an energy increment $e_{5'}$ to the chamber 1.2 and thereby trigger the misfired prunit P.

Because of the delay in the firing of the prunit, owing to the misfire, and the special ignition approach described above, the weapon does not undergo the aforedescribed counter-recoil firing.

I have described below the second energy input 5'.3 of the energy converter 5'.1. Ahead of this second energy input 5'.3 (see FIG. 5) there is provided a signal transmitter 5'.14 whose input 5'.15 receives an energy increment represented at e m with an arrow. The latter represents a device for delivering an emergency energy increment em in the direction of the arrow with the same designation. While the first input 5'.2 is in a force-transmitting relationship with an element of the base energy unit 8 and/or an energy source not further described, the input 5'.3 requires an external energy supply for the emergency energy requirement $e_m$. This additional quantity of energy may be supplied by hand.

Together with the second energy input 5'.3, the energy converter 5'.1 can be compared to a manually actuated pulse generator for emergency triggering of a weapon. The input of the emergency energy increment $e_m$ forms in the signal transmitter 5'.14 a signal "emergency" which is applied to the signal input 5'.13 of the control circuit 5'.9.

The "emergency" signal replaces the sum or addition signal previously mentioned and opens the output 5'.7 of the energy storage device 5'.5. If the energy converter 5'.1 has its first input 5'.2 connected to an energy source which can continuously charge the energy storage device 5'.5, the connection between 5'.3 and the output 5'.16 can be omitted.

The auxiliary signal transmitter 5.22 ahead of the input 5.20 of the control circuit 5.8 includes a signal transmitter to replace the signal "advance X" for a given first firing cycle. In other words, since prior to its first firing the weapon does not undergo a recoil/counter-recoil movement, it cannot be fired on counter-recoil (advance X) so that the enabling signal which causes such firing for all successive rounds must be replaced for the first round by a substitute signal. It is this signal which is delivered by the auxiliary signal transmitter 5.22.

The formation of the auxiliary signal as the enabling signal or condition-preceding signal for the summing or addition signal, can be effected by branching the "locked" signal, for example via the line 3.32, so that this signal is applied to the auxiliary signal transmitter 5.22. In a manner which will not be described in further detail, the signal "advance X" applied via the line 9.50 to the circuit 5.8 can cancel the auxiliary signal from the transmitter 5.22.

Aside from the differences which will be apparent from the foregoing description with respect to the ignition devices 5 and 5', it should be noted that in principle the two differ mainly by the use of different energy sources.

For the same central unit Z, different base weapons $B_1 \ldots B_n$ can be used in accordance with the respective operating type. The term "operating type" is here used to indicate units which are activated by different primary energy sources Q, e.g., self-energized systems (gas-pressure energization with gas venting bores 1.6 of the type shown in FIGS. 2 and 3) and external-energy activated, the various energy converters R.5 required for the different types of energy used being designed accordingly. As a result, for a number k of different arming sets $R_1 \ldots k$, each arming set is of a different design for the respective number k-1 of the different arming sets for a base-unit weapon B whose arming set does not correspond to a respective one of the k-1 collection of arming sets.

The energy converter R.5 is preferably of a type which will allow the associated energy source Q to provide the primary energy $e_1$ of the energy transfer 8 in the form of a torque or in such form as enables it to be converted readily into a torque. The types of energy converters are, of course, dependent upon the types of primary energy sources and, in general, the principle should be to convert the particular energy used into a torque for operation of the energy chains or paths $F_1$, $F_2$.

With gas-pressure chargers (i.e. compressors or accumulators), the primary energy returned is that of the expandable propellant gases which are recovered from the firing of a previous projectile. The inner chamber 1.7 of the barrel 1 thus includes the energy source Q which thus becomes an intrinsic component of the central unit Z.

This can be understood in terms of the concepts of intrinsic energy and intrinsic drive (automatic recovery of the firing energy). The gas pistons 81, 82 (FIG. 3) are displaced by the pressure of the propellant gases which are delivered to the cylinders of these pistons by nozzle bodies 85 and 86 connected to the gas-venting bores 1.6. The gas pistons 81, 82 act upon respective levers 83, 84 which are common to the energy converter R.5 (FIG. 1) in that they can drive the respective shafts 8.9 and 8.10, e.g. via a respective clutch and force-storing means R.15 and R.16.

The connection of these levers 83 and 84 to the shafts 8.9 and 8.10 can be conventional in the art and may make use of conventional mechanical clutches, force-storing springs and the like. It is only important to the present invention at this point to emphasize that the gas of the chamber of the barrel serves here as the pressure source for operating the energy-flow paths $F_1$, $F_2$ previously discussed in some detail.

If the energy source Q for the primary energy $e_1$ is a main power supply common to all of the weapon stations, i.e. if the system is operated with an external energy source, the energy converter of the respective arming set R can be a motor driven by the electric power of this network or supply. Reference may be made to German patent application P 26 58 770.2 for the various types of connections at the junctions $S_1$ to the energy source Q.

This patent also describes a control of the primary energy supply for energy transfer (for example with the formation of a respective control signal from the propellant gas pressure upon fire development). When the control signals are to be generated by gas pressures and the system uses an external energy source, at least one of the gas venting bores 1.6 can be completely closed. The flow cross section of the other gas venting bore 1.6 can be dimensioned to meet the revised conditions, for example by providing it with a corresponding nozzle body such as has been shown at 85 or 86 in FIG. 3. The control signal for the energy feed with an external energy supply can, however, (see FIG. 5 and the associated description) be triggered by the "fire development" signal generated by the signal transmitter 32. This use of the signal is represented by a line 38 which is connected at a tie point 37 with the line 35.

Naturally, in all of the aforedescribed systems, the various signals can be gas-pressure signals although liquid-pressure signals or electrical signals may be employed as well.

When the system is primarily pneumatic in nature, i.e. operates with a gas under pressure, a control signal is preferably also generated by the propellant-pressure energy via the gas-venting bores 1.6 and is branched to the primary-energy input for the energy transfer described previously. A signal tansmitter 32', which corresponds to the signal transmitter 32 for forming the "fire development" signal for the control circuit 5.9, can advantageously lie in one of the energy flow paths $F_1$, $F_2$.

An advantageous arrangement has been shown in FIG. 5 in which a nozzle body 85, represented only diagrammatically, includes the signal transmitter 32' whose output 34' is connected by a line 35' with a tie point 36 of the line 35 which runs to the signal input 5'.11 of the control circuit 5'.9.

The characteristics of a form-changing set for a given terminal unit from a predetermined number $(n+x-1)$ of different terminal devices also encounters respective compatible combinations of gun mounts and munition magazines (thus peripheral units L, U). Since numerous modifications of these relationships may be developed within the concepts of the present invention, only preferred details will be described in connection with, for example, FIGS. 2 and 3.

For example, part of the respective bearings 9.25 for the trunnions 2.15 of the weapon housing 2 are integrated in the housing 9.1 of the recoil/counterrecoil device 9, which results in an advantageous and extremely light construction with a reduced cross section of the weapon (see especially FIG. 3) and also good control and maneuverability thereof. This is particularly the case because the reaction and acceleration forces can be taken up readily, especially when the weapon is built into a complex support system of the type used in compact helicopters and multi-purpose combat aircraft capable of being used for air-to-ground and air-to-air combat purposes.

The terminal units $E_6$–$E_9$ of FIGS. 6–9, respectively, are also composed of systems components according to the invention which allow for multipurpose operation of the weapons system with instantaneously recognizable advantages.

Figure 6:
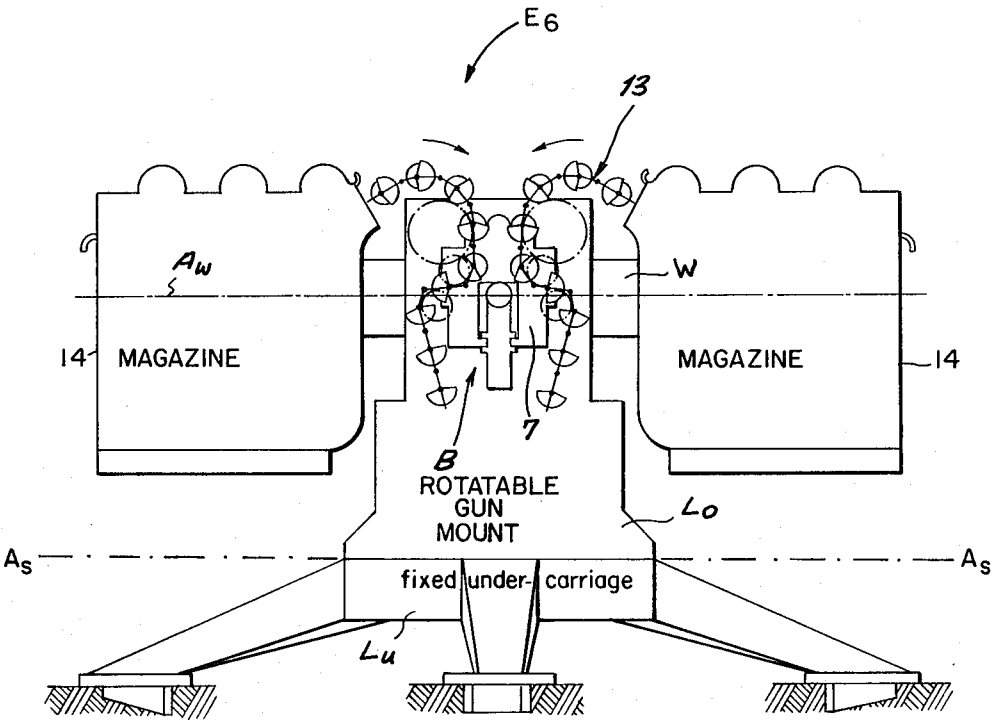
FIG. 6 is a diagram of a terminal device for the automatic supply of weapons on a field mount, with cradle-fixed magazine close to the firing portion of a weapon.

The terminal unit $E_6$ shown in FIG. 6 comprises a ground-based lower gun mount $L_u$ as provided in the field, i.e. for use as field artillery, which has a traversing axis $A_s$ about which the upper gun mount $L_0$ is rotatable. The upper gun mount $L_0$ comprises a pair of magazines or receptacles 14 in rocker-type arrangements for belted prunits P of the two types A and B mentioned previously. An axis $A_W$ of the two trunnions 2.15 (FIG. 3) lies in a common plane with the bore axis $A_0$ (FIG. 1).

Figure 7:
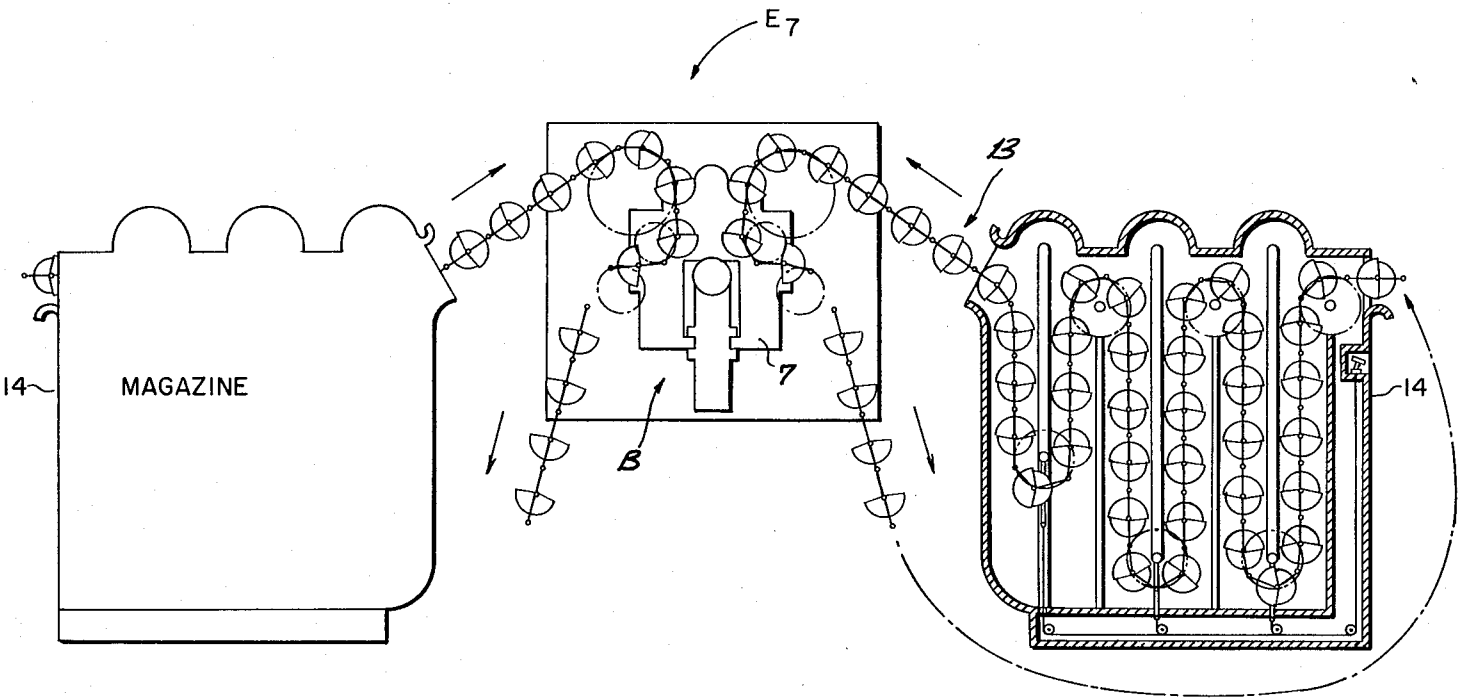
FIG. 7 is a diagram illustrating another type of weapons supply.

While avoiding the detailed illustration of the gun mounts for the base unit of FIG. 6, it can be seen from the terminal device $E_7$ of FIG. 7 that each of the belts from the magazines 14 for the belted prunit rounds can be fed to the weapon. The belt feed can be similar to that used in the embodiment of FIG. 6.

To permit viewing of the loaded munitions belt 13 in FIG. 7, an end wall of the right-hand receptacle 14 has been removed or broken away. As can be seen from the schematic diagram of this Figure, a given supply of loaded pockets are provided on the belt 13 in a multiplicity of vertical stretches within each magazine 14 while the empty belt passes around the magazine to the inlet side thereof, the empty pockets being fillable by hand. The munitions belt also may be separated, i.e. opened to allow its elongation by hand. This can be used to increase the munitions supply for high-rate firing.

The munitions supplies proximal to the weapon allow the selective feeding of rounds A or B from a respective side of receptacle 14 and from magazines which are fixed to the gun rocker or cradle, thereby simplifying the gun mounts. This is especially important for self-contained ground units.

Figure 8:
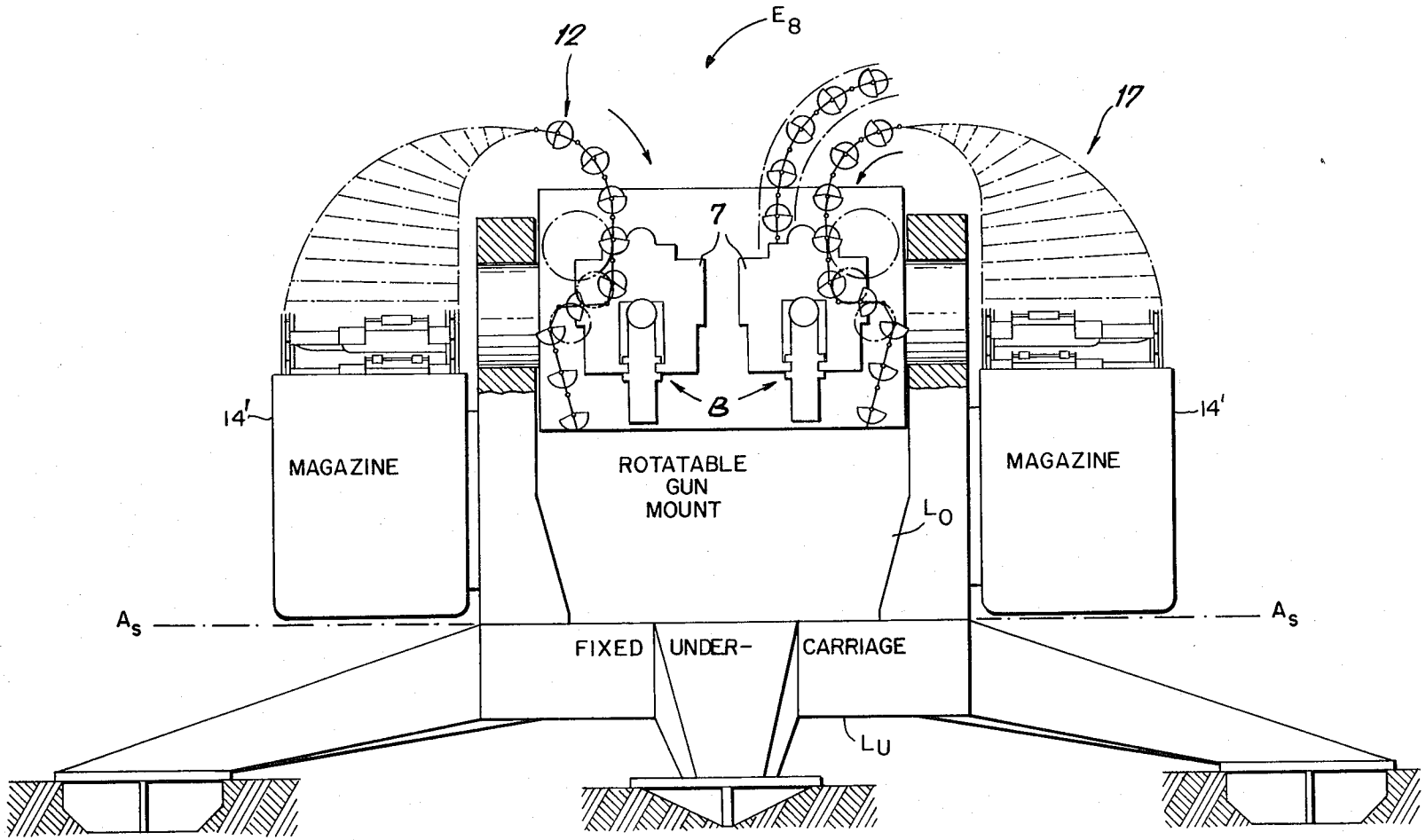
FIG. 8 shows the terminal device of still another system using a magazine close to the weapon itself.

FIG. 8 shows a terminal device $E_8$ with a lower gun mount or undercarriage $L_u$ fixed to the ground and an upper gun mount $L_o$ rotatable about the axis $A_s$ and provided with two base units B and two receptacles or magazines 14' for prunits P secured to the upper gun mount and disposed so as to retain the prunits P in a direction perpendicular to the bore axis $A_o$ of each of the weapons. In this embodiment, the munitions channels form flexible feed passages as shown at 17 for the munitions belt 12 whereby each weapon is fed with a respective sequence of munitions. As has been shown in FIG. 8, in addition, for the right-hand receptacle 14', an additional munitions belt can be fed to the right-hand weapon in the manner shown in FIG. 7 through still another guide channel. Each of the terminal devices for a respective gun mount as shown in FIGS. 6, 7 and 8 includes, therefore, at least one weapons set B, i.e. at least one single-barrel automatic cannon, and at least one arming set R for operation from the central unit by the pneumatic principles described in connection with FIGS. 2 and 3. The central unit may operate a multiplicity of the weapons setups of the type shown in FIGS. 6–8.

Figure 9:
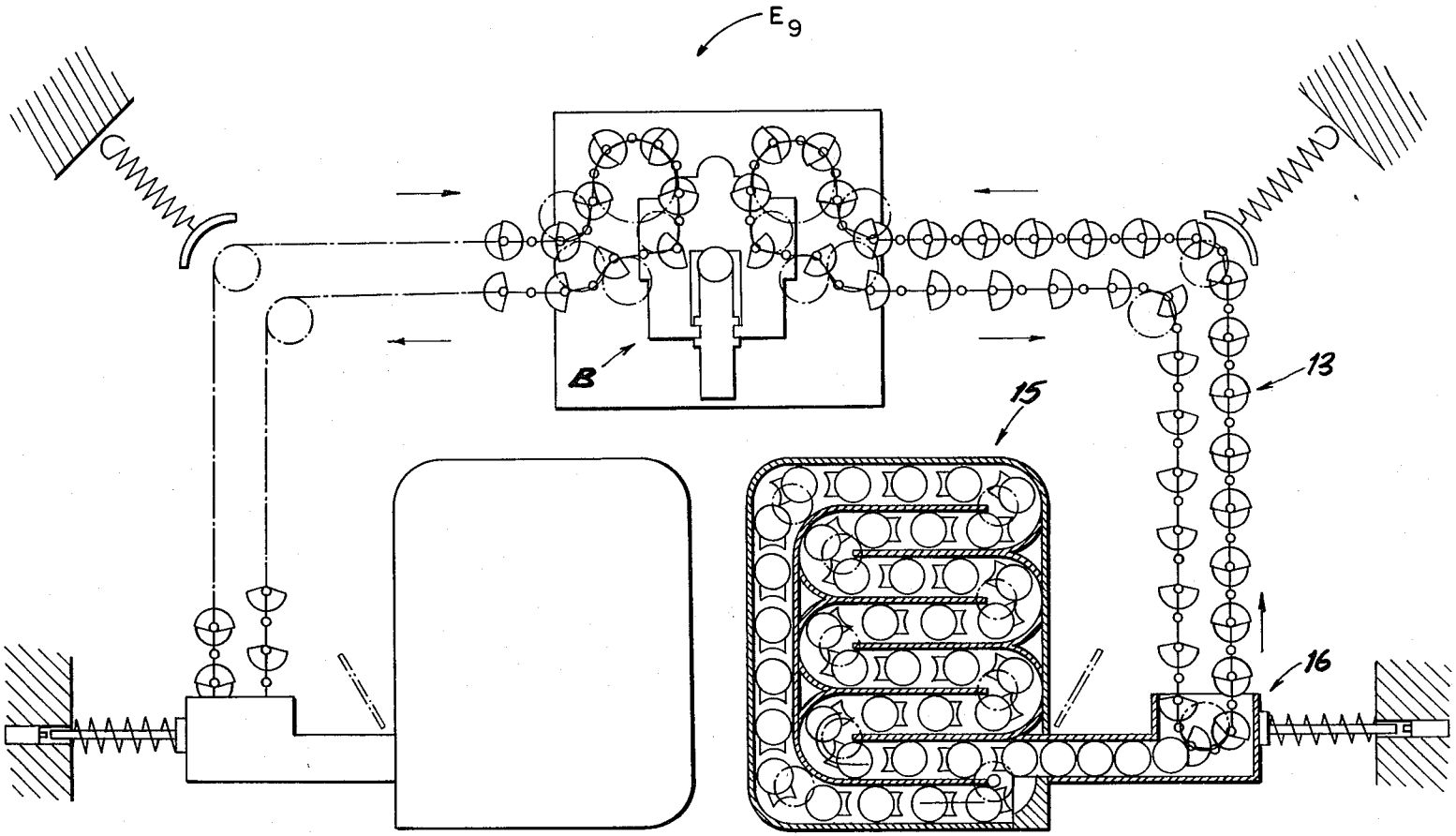
FIG. 9 is yet another diagram illustrating the feeding of a weapon in accordance with the present invention.

The terminal device $E_9$ shown in FIG. 9 includes a munitions container or magazine 15 proximal to the weapon and provided with a munitions belt 13 of endless configuration with automatic refilling of the pockets of the belt from the container which can be of any desired configuration but preferably includes means for advancing the individual prunits to the pockets of the belt 13 on which they are mounted via the belt loader 16.

The terminal device $E_9$ is preferably integrated in a complex support system, for example, a combat helicopter or multi-purpose combat aircraft or tank. The associated central unit is here provided with an arming set R which can be operated by external energy, e.g. from the main power supply of the vehicle. The weapon units B, as well as the peripheral devices and even the entire central unit can be interchangeable upon the carrier system.

From the foregoing description it will be apparent that the invention with its illustrated and described systems components constitutes both a military and a technical advance over the art. In particular, it has been found that the wedge-type breech block with its reduced acceleration forces imposes less stress upon the weapon structure itself and is centrally disposed between the mechanical coupling chains to ensure an absolutely reliable system for eliminating misfires with a locked breech. The arrangement for testing and checking the components and devices, especially with the generally interchangeable parts of the associated central unit, are of special significance in this case.

I claim:

1. A weapons system comprising:

a plurality of central units each comprising a single-barrel automatic weapon, a respective munitions loader for loading individual rounds of munitions into a chamber of the respective weapon, a respective breech block closable for firing of the round in the chamber, said rounds each comprising a PRUNIT consisting of a projectile and a solid body of propellant affixed to said projectile and ignitable to propel the projectile through the barrel, and a respective arming set for at least some of said weapons, each arming set comprising means defining first and second energy-flow paths including respective shafts adapted to transmit torque from input ends to output ends of the path, at least one of the shafts being connected operatively to said breech block for shifting same between open and closed positions, at least one of the shafts of each energy-flow path being operatively connected to said loader of at least one weapon associated with the arming set, each arming set including an energy converter for transforming energy from an energy source into a torque of at least one of the shafts thereof, the respective weapons being combined with respective arming sets and energy converters in accordance with the respective operating characteristics of the weapon in terms of the nature of the energy applied to operate same;

a recoil/counterrecoil mechanism associated with at least some of said weapons; and a respective munitions feeder for feeding PRUNITS to each of said loaders, at least some of said munitions feeders being provided with two munitions magazines each receiving PRUNITS of different type and a selector for advancing a PRUNIT of a selected type from one of the magazines to the respective loader.

2. The weapons system defined in claim 1 wherein each central unit comprises a barrel provided with a respective one of such chambers, the wall of the barrel being formed with at least one throughgoing gas-venting bore, a weapon housing receiving said barrel and enclosing said breech block, a triggering device for triggering the firing of a round in the respective chamber, an ignition device connected to said triggering device for igniting the propellant charge of a round in the respective chamber, a device for eliminating a misfire, and means for controlling the cadence of firing of the respective weapon, a first of the shafts of one of said central units being connected to the respective loader while a second of said shafts of the respective central unit is connected to said munitions feeder for driving same, said recoil/counterrecoil mechanism including means for storing secondary energy upon recoil of the barrel of the respective weapon and control means for releasing the stored secondary energy.

3. The weapons system defined in claim 2 wherein each of said energy-flow paths comprises a respective input and respective inner and outer outputs, the loader being operatively connected to the outer output of said first shaft and the munitions feeder being connected to the outer output of said second shaft.

4. The weapons system defined in claim 3, further comprising an initial-energy store associated with each of said arming sets, and means for operatively connecting said initial-energy store to one of the shafts of the respective central unit for applying an initial torque thereto prior to the first firing of a round from the respective weapon.

5. The weapons system defined in claim 4 wherein both of said inner outputs of the energy-flow paths of each central unit are connected to a common breech block for displacing same.

6. The weapons system defined in claim 5 wherein the respective central units are provided with respective auxiliary ignition sources for igniting the propellant charges of misfired PRUNITS while the respective breech block is closed to eliminate misfires.

7. The weapons system defined in claim 6 wherein said recoil/counterrecoil mechanism includes a signal generator connected to the means controlling the cadence of firing of the respective weapon for initiating the firing of a round in the respective chamber during the counterrecoil movement of the respective barrel.

8. The weapons system defined in claim 7 wherein each barrel is provided with a signal transmitter responsive to the presence of a round in the respective chamber for enabling the respective ignition device and a further sensor responsive to the firing of a projectile from the respective barrel for inactivating the device for eliminating a misfire in the respective chamber.

9. The weapons system defined in claim 8 wherein each weapon is provided with a weapon cradle at least partly integrated in a housing of the respective recoil/-counterrecoil mechanism.

10. The weapons system defined in claim 9 wherein each breech block constitutes a coupling member interconnecting the two shafts of each central unit for joint operation.

11. The weapons system defined in claim 10 wherein the inner outputs of each of the energy-flow paths of each central unit comprise respective cam grooves rotatable about the respective shaft axes and driven by the first and second shafts, respective bell crank levers each having a lever arm forming a cam follower and engaged in a respective one of said grooves and a further arm, said further arms being articulated to opposite sides of the respective breech block, said grooves being constructed and arranged to fully lock the respective breech block in a closed position of the respective chamber.

12. The weapons system defined in claim 11 wherein each of said breech blocks is of the wedge type.

13. The weapons system defined in claim 2 wherein each trigger device comprises a catcher abutment on one of the shafts of the respective central unit and a catcher cam engageable with said catcher abutment and adapted to release the same to permit rotation on the shaft to which it is connected for initiating a firing cycle of the respective weapon.

14. The weapons system defined in claim 13 wherein said shafts of each central unit have axes parallel to the bore axis of a respective weapon and lie in an imaginary vertical plane including the bore axis and intersecting the path of movement of the respective breech block.

15. The weapons system defined in claim 14 wherein each of said breech blocks comprises an upper closing portion and a lower guiding portion, the closing portion extending perpendicularly to the bore axis of the respective weapon and said guiding portion including an angle $\alpha_3$ with the respective bore axis.

16. The weapons system defined in claim 2 wherein each loader and the respective munitions feeder extend over predetermined distances one below the other from the rear end of the chamber of the respective weapon, each round having an axis coinciding with the axis of the respective bore when disposed on the respective loader prior to advance of the round into the respective chamber.

17. The weapons system defined in claim 16 wherein said each loader comprises a pair of sprocket wheels spaced apart rearwardly of the respective weapon and spanned by an endless chain adapted to carry the respective PRUNIT into the respective chamber.

18. The weapons system defined in claim 17 wherein said chain is provided with a plurality of entraining fingers adapted to advance respective PRUNITS into the chamber of the respective weapon, each of said fingers being disposed adjacent a respective one of said sprocket wheels in a position of said chain wherein a PRUNIT is about to be advanced toward the respective chamber.

19. The weapons system defined in claim 18 wherein said feeder and said loader are so constructed and arranged and so coupled together that they are driven in force-transmitting relationship synchronously to feed a respective PRUNIT to the respective loader and advance the PRUNIT on said loader into the respective chamber in the cadence of firing of the respective weapon.

20. The weapons system defined in claim 19, further comprising a signal generator for producing a signal responsive to the position of the breech block indicating a locked condition thereof, each weapon being provided with a further signal generator for producing a "LOADED" signal upon the disposition of the respective round in the respective chamber, and means responsive to said signals for enabling said ignition device and the device for eliminating misfires.

21. The weapons system defined in claim 2 wherein the device for eliminating misfires is constructed and arranged so as to be actuated by hand.

* * * * *